US010431365B2

(12) United States Patent
Kubota et al.

(10) Patent No.: US 10,431,365 B2
(45) Date of Patent: Oct. 1, 2019

(54) ELECTRONIC COMPONENT AND METHOD FOR MANUFACTURING ELECTRONIC COMPONENT

(71) Applicant: MURATA MANUFACTURING CO., LTD., Kyoto-fu (JP)

(72) Inventors: Hironobu Kubota, Nagaokakyo (JP); Mitsunori Inoue, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 52 days.

(21) Appl. No.: 15/052,438

(22) Filed: Feb. 24, 2016

(65) Prior Publication Data

US 2016/0260535 A1 Sep. 8, 2016

(30) Foreign Application Priority Data

Mar. 4, 2015 (JP) ..... 2015-042180
Dec. 9, 2015 (JP) ..... 2015-239973

(51) Int. Cl.
*H01F 17/00* (2006.01)
*H01F 17/04* (2006.01)
*H01F 27/29* (2006.01)

(52) U.S. Cl.
CPC ..... *H01F 17/0013* (2013.01); *H01F 17/04* (2013.01); *H01F 27/292* (2013.01); *H01F 2017/048* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

2002/0050909 A1* 5/2002 Jinno ..... H01C 1/034 338/21
2007/0209737 A1 9/2007 Satsu et al.
2008/0160199 A1 7/2008 Nadupparambil Sekharan et al.
2013/0038419 A1* 2/2013 Kobayashi ..... H01F 17/0013 336/200
2013/0222101 A1* 8/2013 Ito ..... H01F 17/04 336/83

(Continued)

FOREIGN PATENT DOCUMENTS

CN 102314995 A 1/2012
JP 2003-145034 A 5/2003

(Continued)

OTHER PUBLICATIONS

An Office Action; "Notice of Submit Response," issued by the Korean Patent Office dated Jun. 8, 2017, which corresponds to Korean Patent Application No. 10-2016-0025883 and is related to U.S. Appl. No. 15/052,438; with English language translation.

(Continued)

*Primary Examiner* — Tszfung J Chan
(74) *Attorney, Agent, or Firm* — Studebaker & Brackett PC

(57) ABSTRACT

An electronic component includes a main body made from a metal magnetic powder and an insulating resin, a coating film covering the surface of the main body, a conductor disposed inside the main body, inorganic particles adhering to the surface of the coating film, and outer electrodes which are electrically connected to the conductor and which cover portions of the surface of the coating film while inorganic particles adhere to the portions, wherein the coating film contains a resin and metal cations.

8 Claims, 5 Drawing Sheets

(56) References Cited

U.S. PATENT DOCUMENTS

| | | | | |
|---|---|---|---|---|
| 2014/0145814 | A1* | 5/2014 | Lee | H01F 17/0013 336/200 |
| 2014/0184374 | A1 | 7/2014 | Park et al. | |
| 2015/0325369 | A1 | 11/2015 | Inoue et al. | |
| 2016/0035476 | A1* | 2/2016 | Mimura | H01F 17/0006 336/199 |
| 2016/0086716 | A1* | 3/2016 | Choi | H01F 27/292 336/221 |

FOREIGN PATENT DOCUMENTS

| | | | | |
|---|---|---|---|---|
| JP | 2003-523482 | A | | 8/2003 |
| JP | 2010-511785 | A | | 4/2010 |
| JP | 2012-009548 | A | | 1/2012 |
| JP | 2012009548 | A | * | 1/2012 |
| JP | 2013-225718 | A | | 10/2013 |
| KR | 10-2007-0093348 | A | | 9/2007 |
| KR | 10-2014-0085997 | A | | 7/2014 |
| WO | 01/60935 | A1 | | 8/2001 |
| WO | 2014/119564 | A1 | | 8/2014 |

OTHER PUBLICATIONS

The First Office Action issued by the State Intellectual Property Office of People's Republic of China dated Jun. 20, 2017, which corresponds to Chinese Patent Application No. 201610124915.2 and is related to U.S. Appl. No. 15/052,438; with English language translation.

"Submission of Information," submitted to the Japanese Patent Office on Jan. 17, 2018, which corresponds to Japanese Patent Application No. 2015-239973 and is related to U.S. Appl. No. 15/052,438.

An Office Action; "Notification of Reasons for Refusal" mailed by the Japanese Patent Office dated Jul. 10, 2018, which corresponds to Japanese Patent Application No. 2015-239973 and is related to U.S. Appl. No. 15/052,438.

M. Yanagi, K. Karube, A. Suda, "Deposition Mechanism of Self-deposition Coating System", Journal of the Surface Finishing Society of Japan, 1999, pp. 559-564, vol. 50, No. 6, Japan.

* cited by examiner

ELECTRONIC COMPONENT AND METHOD FOR MANUFACTURING ELECTRONIC COMPONENT

CROSS REFERENCE TO RELATED APPLICATIONS

This application claims benefit of priority to Japanese Patent Application 2015-042180 filed Mar. 4, 2015, and to Japanese Patent Application No. 2015-239973 filed Dec. 9, 2015, the entire content of which is incorporated herein by reference.

TECHNICAL FIELD

The present disclosure relates to an electronic component and a method for manufacturing the electronic component. In particular, the present disclosure relates to an electronic component including a main body produced from a material composed of a mixture of a metal magnetic powder and an insulating resin and a method for manufacturing the electronic component.

BACKGROUND

A coil component described in Japanese Unexamined Patent Application Publication No. 2013-225718 is known as a disclosure of the electronic component in the related art. In the electronic component, an internal circuit element is covered with a resin containing a metal magnetic powder. The electronic component is subjected to a chemical conversion treatment with a phosphate for the purpose of, for example, rust prevention of the metal magnetic powder. An insulating coating film is formed on the surface of the insulator by the chemical conversion treatment. A terminal electrode is disposed on the insulating coating film.

The coil component described in Japanese Unexamined Patent Application Publication No. 2013-225718 has a problem that the terminal electrode easily peels from the insulator.

SUMMARY

Accordingly, it is an object of the present disclosure to provide an electronic component and a method for manufacturing the electronic component, wherein firm, close contact of outer electrodes with a main body can be facilitated.

According to preferred embodiments of the present disclosure, an electronic component includes a main body produced from a material composed of a mixture of a metal magnetic powder and an insulating resin, a coating film covering the surface of the above-described main body, a conductor disposed inside the above-described main body, inorganic particles adhering to the surface of the above-described coating film, and outer electrodes which are electrically connected to the above-described conductor and which cover portions of the surface of the coating film while the above-described inorganic particles adhere to the portion wherein the above-described coating film contains a resin and metal cations.

According to preferred embodiments of the present disclosure, a method for manufacturing the electronic component includes the steps of preparing a main part including a main body made from a metal magnetic powder and an insulating resin and a conductor located inside the above-described main body, preparing a mixed solution containing an ionizing component for ionizing a metal constituting the above-described metal magnetic powder, an anionic surfactant, and a resin component, coating the above-described main body with the above-described mixed solution and performing drying, and making a dispersion that contains inorganic particles adhering to the above-described main body and performing drying.

Other features, elements, characteristics, and advantages of the present disclosure will become more apparent from the following detailed description of preferred embodiments of the present disclosure with reference to the attached drawings.

DETAILED DESCRIPTION

An electronic component according to an embodiment of the present disclosure will be described below with reference to the drawings.

Configuration of Electronic Component

Figure 1:
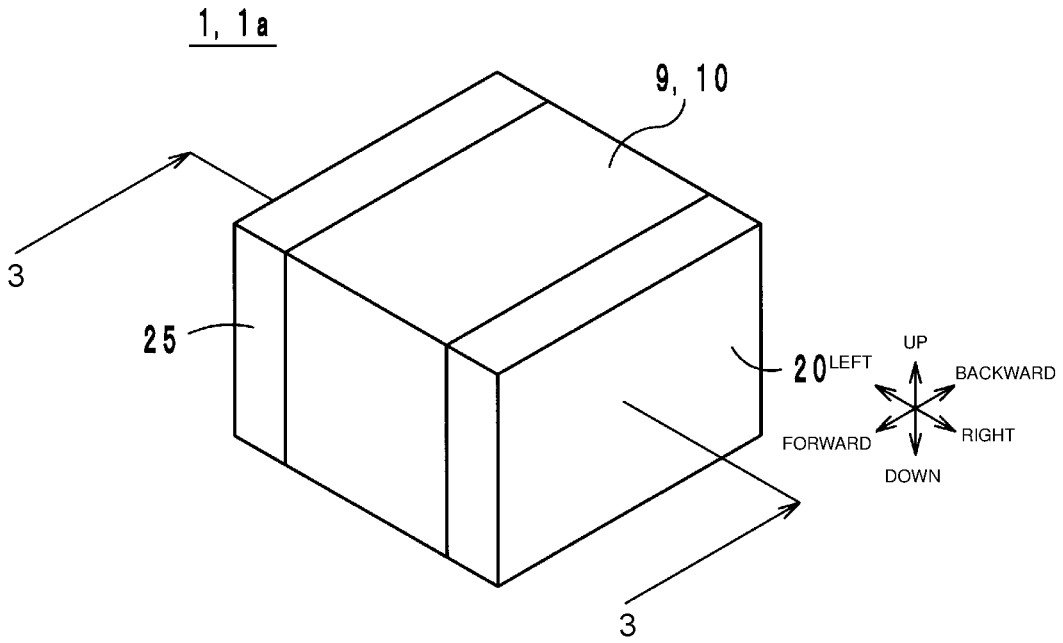
FIG. 1 shows an outside perspective view of an electronic component.
Figure 2:
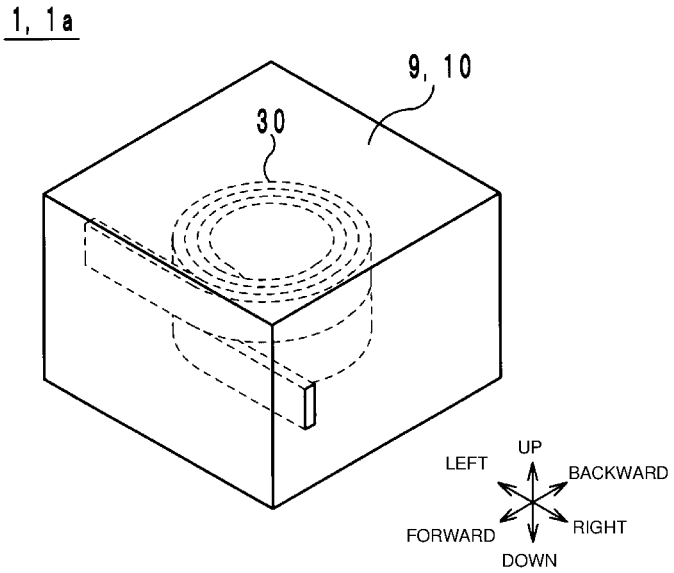
FIG. 2 shows a perspective view of the electronic component.
Figure 3:
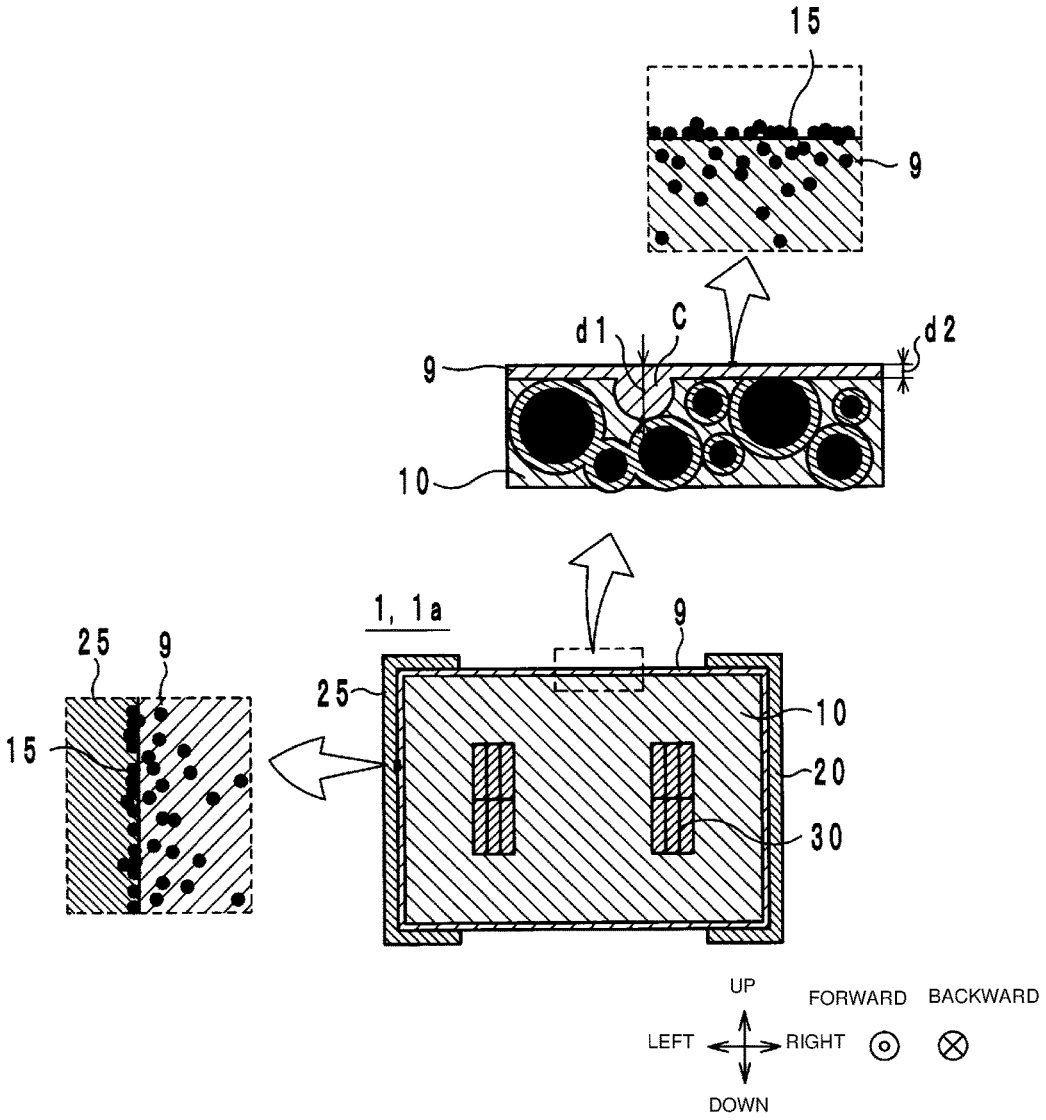
FIG. 3 shows a structural sectional view along a line 3-3 shown in FIG. 1 and shows magnified diagrams.

The configuration of the electronic component will be described below with reference to the drawings. FIG. 1 shows an outside perspective view of an electronic component 1 according to an embodiment of the present disclosure. FIG. 2 shows a perspective view of the electronic component 1. In FIG. 2, outer electrodes 20 and 25 are not shown. FIG. 3 shows a structural sectional view along a line 3-3 shown in FIG. 1 and shows magnified diagrams. Hereafter, the direction of alignment of the outer electrodes 20 and 25 is defined as the lateral direction and the direction of extension of the center axis of a coil 30 is defined as the vertical direction. The direction orthogonal to the lateral direction and the vertical direction is defined as the forward or backward direction. The forward or backward direction, the lateral direction, and the vertical direction are orthogonal to each other.

As shown in FIGS. 1 to 3, the electronic component 1 includes a coating film 9, a main body 10, inorganic particles 15, outer electrodes 20 and 25, and a coil 30.

The material for the main body 10 is a mixture of a metal magnetic powder and an insulating resin. The insulating resin is a resin having an electrically insulating property. Examples of insulating resins include epoxy resins and silicon resins. As shown in FIGS. 1 and 2, the main body 10 has a substantially rectangular parallelepiped shape, although the shape of the main body 10 is not limited to this. In the present embodiment, the main body 10 is produced from the mixture of the metal magnetic powder and the epoxy resin. In order to increase the density of the metal magnetic powder in the main body 10, the metal magnetic powder comprises particles of two particle diameters. However, the main body needs to include at least one metal magnetic powder. Specifically, the metal magnetic powder is a mixed powder of a magnetic powder composed of an Fe—Si—Cr alloy having particles with an average particle diameter of about 80 μm (maximum particle diameter of about 100 μm) and a magnetic powder composed of Fe carbonyl having particles with an average particle diameter of about 3 μm. The metal magnetic powder may include a powder of Fe, an alloy powder containing Fe, or an amorphous powder containing Fe. Examples of the Fe alloy include Fe—Si alloys, Fe—Si—Cr alloys, and Fe—Si—Al alloys. An insulating coating film which is composed of a metal oxide and which serves as an insulating film is applied in advance to these powders by a chemical conversion treatment. The insulating coating film formed on the metal magnetic powder is not necessarily the metal oxide. The insulating film may be formed from, for example, a silicon resin or glass. In consideration of the inductance values and the direct current superposition characteristics of the electronic component 1, about 90 percent by weight or more of metal magnetic powder relative to the main body 10 may be contained. The resin contained in the main body 10 may be an insulating inorganic material, e.g., a glass ceramic, or a polyimide resin.

The coil 30 is an example of a conductor disposed inside the main body 10 and is formed by winding a copper wire. Specifically, the copper wire has a substantially rectangular cross-sectional shape having a major axis extending in the vertical direction. The surface of the copper wire is covered. The coil 30 has a two-stage structure. In the upper stage of the coil 30, a conductor wire is wound counterclockwise from the outer circumference side toward the inner circumference side in plan view. In the lower stage of the coil 30, a conductor wire is wound counterclockwise from the inner circumference side toward the outer circumference side in plan view. Consequently, the center axis of the coil 30 extends in the vertical direction.

The end portion on the inner circumference side of the upper stage of the coil 30 is connected to the end portion on the inner circumference side of the lower stage of the coil 30. The end portion on the outer circumference side of the upper stage of the coil 30 is exposed to the outside at the left surface of the main body 10. The end portion on the outer circumference side of the lower stage of the coil 30 is exposed to the outside at the right surface of the main body 10. The material for the coil 30 need only have electrical conductivity, examples of which include, in addition to Cu, Au, Ag, Pd, and Ni.

The coating film 9 covers the surface of the main body 10. The coating film 9 does not necessarily cover the entire surface of the main body 10 and the only requirement is to cover at least part of the main body 10. In the present embodiment, the coating film 9 covers almost the entire surface of the main body 10. However, in order not to impair the connection between the coil 30 and the outer electrodes 20 and 25, the coating film should preferably not cover the portions at which both end portions of the coil 30 are exposed from the main body 10 to the outside. The coating film 9 contains a resin and metal cations. The metal cations contained in the coating film 9 may be Fe cations, Ni cations, Co cations, Al cations, and/or Cr cations. The coating film 9 may contain cations of a plurality of metal elements. The resin may be an acrylic resin. The acrylic resin may have a cross-linked structure. It is preferable that the thermal decomposition temperature of the resin contained in the coating film 9 be high in consideration of applying solder during mounting of the electronic component 1 to a circuit substrate. For example, in the case where the thermal decomposition temperature is specified to be the temperature at which about 5% of mass reduction of the resin contained in the coating film 9 occurs, the thermal decomposition temperature is about 240° C. or higher. The thermal decomposition temperature may be measured using the following analyzer and under the following analytical condition.

Analyzer: TG-DTA 2000SA (produced by NETZSCH Japan K.K.)

Analytical Condition:

Temperature profile: RT→300° C. (10° C./min)

Measurement atmosphere: reduced pressure (use of rotary pump: 0.1 Pa)

Sample cell material: Al

Measurement sample weight: 100 mg

X-ray photoelectron spectroscopy (XPS) is mentioned as an analytical method for examining ions (cations) of the elements constituting the metal magnetic powder contained in the coating film 9. The measurement condition of the XPS is as described below.

Measurement apparatus: PHI 5000 VersaProbe produced by ULVAC-PHI, Inc.

X-ray source: Al—Kα line

Measurement region: diameter of 100 μm

Acceleration energy of X-ray: 93.9 eV

Time per measurement step: 100 ms

Number of acquisitions of Fe2p: 500

Energy calibration: C1s=284.6 eV

According to the analysis of the coating film 9 by XPS, in the Fe2p3 spectrum, a peak indicating the presence of the Fe cation can be observed in the vicinity of 710 eV. On the other hand, there is no peak indicating the presence of the Fe metal (Fe in the metal state) in the vicinity of 707 eV. Consequently, the presence of ions (cations) of the elements constituting the metal magnetic powder contained in the coating film 9 can be verified.

Examples of the resin component contained in the coating film 9 include epoxy resins, polyimide resins, silicone resins, polyamide imide resins, polyether ether ketone resins, fluororesins, acryl silicone resins, and the like besides the acrylic resin. Additional examples of resin components contained in the coating film 9 include acrylic resin emulsions, e.g., methyl methacrylate resins, acrylonitrile-styrene-acrylic copolymers, and styrene-acrylic copolymers. Specific products include Nipol SX1706A, SX1503A, LX814, and LX855EX produced by ZEON Corporation and Neocryl A-639, A-655, and A-6015 produced by Kusumoto Chemicals, Ltd.

The monomer used as the resin component contained in the coating film 9 is not specifically limited. Examples thereof include (meth)acrylic acid, methyl acrylate, ethyl acrylate, n-butyl acrylate, isobutyl acrylate, t-butyl acrylate, dodecyl acrylate, stearyl acrylate, 2-ethylhexyl acrylate, tetrahydrofurfuryl acrylate, diethylaminoethyl acrylate, 2-hydroxyethyl acrylate, 2-hydroxypropyl acrylate, methacrylic acid, methyl methacrylate, propyl methacrylate, n-butyl methacrylate, isobutyl methacrylate, t-butyl methacrylate, n-octyl methacrylate, dodecyl methacrylate, 2-ethylhexyl methacrylate, stearyl methacrylate, diethylaminoethyl methacrylate, 2-hydroxyethyl methacrylate, 2-hydroxypropyl methacrylate, glycol esters of (meth) acrylic acid, e.g., ethylene glycol mono(meth)acrylate and polyethylene glycol mono(meth)acrylate, alkyl vinyl ethers, e.g., methyl vinyl ether and ethyl vinyl ether, vinyl esters, e.g., vinyl acetate, N-alkyl-substituted (meth)acrylamides, e.g., N-methylacrylamide, N-ethylacrylamide, N-methylmethacrylamide, and N-ethylmethacrylamide, nitryles, e.g., acrylonitrile and methacrylonitrile, and styrene based monomers, e.g., styrene, ethylene, butadiene, vinyl chloride, vinylidene chloride, vinyl acetate, p-methyl styrene, and α-methyl styrene. These monomers may be used alone or at least two types may be used in combination. The term "(meth)acryl" refers to acryl or methacryl.

As shown in FIG. 3, the coating film 9 enters recessed portions C, which are formed by the metal magnetic powder contained in the main body 10 falling from the main body 10, and almost fills the recessed portions C. As a result, the thickness d1 of the coating film 9 of the recessed portion C is larger than the thickness d2 of the coating film 9 of the other portion of the surface of the main body 10.

Inorganic particles 15 are disposed to facilitate close contact of the outer electrodes 20 and 25 with the coating film 9 and to adhere to at least part of the surface of the coating film 9. Regarding the material for the inorganic particles 15, at least one of elemental metals, alloys, metal oxides, metal nitrides, and the like should be used. For example, silver particles, silica particles, zirconium particles, aluminum oxide particles, and silicon nitride particles may be employed. The inorganic particle may have a multilayer structure composed of a plurality of elementary metals, alloys, metal oxides, metal nitrides, or the like. In the present embodiment, the inorganic particles 15 are silica particles adhering to almost the entire surface of the coating film 9. However, in order not to impair the connection between the coil 30 and the outer electrodes 20 and 25, the inorganic particles 15 should preferably not adhere to the portions at which both end portions of the coil 30 are exposed from the main body 10 to the outside. The inorganic particles may have, for example, a substantially spherical shape. The average particle diameter of the inorganic particles is preferably about 1 nm or more and 200 nm or less. The adhesiveness of the outer electrodes 20 and 25 to the coating film 9 can be improved by using inorganic particles having an average particle diameter within this range. For example, the volume average particle diameter is a median diameter d50.

Adhesion of the inorganic particles 15 to the surface of the coating film 9 does not refer to the state, in which the inorganic particles 15 are uniformly present on the surface and inside the coating film 9 by being mixed into the material for the coating film 9, but refers to the state, in which the inorganic particles 15 are dispersed on the surface of the coating film 9, as shown in the magnified diagrams in FIG. 3. However, part of the inorganic particles 15 are present in the coating film 9. In this case, the amount of the inorganic particles 15 contained in the unit volume of the coating film 9 decreases from the surface of the coating film 9 with increasing proximity to the surface of the main body 10. The inorganic particles 15 are not necessarily in contact with the main body 10. That is, in the coating film 9, the inorganic particles 15 do not necessarily reach the region in the vicinity of the surface of the main body 10. As shown in the magnified diagram on the upper side in FIG. 3, in the present embodiment, the inorganic particles 15 adhere to the portion, which is the surface of the coating film 9 and which is not provided with the outer electrodes 20 and 25, as well. However, the inorganic particles 15 need to adhere to at least the portion between the outer electrode 20 and the coating film 9 and the portion between the outer electrode 25 and the coating film 9 on the surface of the coating film 9.

The surface of the coating film 9 is not entirely covered with the inorganic particles 15. The inorganic particles 15 are sparsely present in such a way that the surface of the coating film 9 can be observed through gaps between many inorganic particles 15. It is preferable that the inorganic particles 15 cover about 20% or more of the coating film 9 in the portion where the inorganic particles 15 adhere to the coating film 9. The inorganic particles 15 may cover the entire coating film 9.

The outer electrode 20 is electrically connected to the coil 30 and covers at least part of the portion, to which the inorganic particles 15 adhere, of the surface of the coating film 9. In the present embodiment, the outer electrode 20 covers the entire right surface of the main body 10 and, in addition, covers part of the upper surface, the bottom surface, the front surface, and the back surface of the main body 10. Consequently, the outer electrode 20 is connected to the end portion on the outer circumference side of the lower stage of the coil 30.

The outer electrode 25 is electrically connected to the coil 30 and covers at least part of the portion, to which the inorganic particles 15 adhere, of the surface of the coating film 9. In the present embodiment, the outer electrode 25 covers the entire left surface of the main body 10 and, in addition, covers part of the upper surface, the bottom surface, the front surface, and the back surface of the main body 10. Consequently, the outer electrode 25 is connected to the end portion on the outer circumference side of the upper stage of the coil 30.

The inorganic particles 15 are present at borders between the outer electrodes 20 and 25 and the coating film 9. The outer electrodes 20 and 25 enter gaps between a plurality of inorganic particles 15 and are in close contact with the surface of the coating film 9.

The above-described outer electrodes 20 and 25 can be produced from a composite material of a metal and a resin. However, the outer electrodes 20 and 25 may be produced by the outer electrode forming method, e.g., plating or sputtering, in the related art.

The thus formed electronic component 1 functions as an inductor, where a signal input into one of the outer electrode and the outer electrode 25 is output from the other outer electrode through the coil 30.

Method for Manufacturing Electronic Component

An example of the method for manufacturing the electronic component 1 will be described.

The main body 10 incorporated with the coil 30 is formed. For example, production can be performed by insert mold forming. Specifically, the coil 30 is prepared and is set into a mold. A mixture of a metal magnetic powder and an epoxy resin serving as the raw materials for the main body 10 is poured into the mold. Thereafter, the epoxy resin is cured. The main body 10 incorporated with the coil 30 is taken out of the mold.

The coating film 9 is formed by applying a mixed solution to the main body 10, where the mixed solution contains an ionizing component having a function of ionizing part of the main body 10 and a resin component contained in the coating film (film formation step). That is, the mixed solution is prepared by mixing the ionizing component, the resin component, and a solvent. The resin component is a compound which is converted to the above-described resin by a reaction. The resin component may be a reactive resin or a nonreactive resin. The reactive resin is a resin having a reactive group. Examples of the reactive group include a hydroxyl group, an amino group, a sulfonic group or a salt thereof, an epoxy group, a phosphoric group or a salt thereof, or a carboxyl group. The reactive resin may be formed from one type of monomer or a plurality of types of monomers. The reactive resin may be, for example, an acrylic resin having a hydroxyl group. The nonreactive resin is a resin which does not have the above-described reactive group. The nonreactive resin is produced from a monomer, e.g., ethylene, propylene, methyl (meth)acrylate, ethyl (meth)acrylate, or styrene. In the mixed solution, the resin component is not necessarily completely dissolved, and the mixed solution may be in an emulsion state.

The ionizing component is specifically a component for ionizing the metal contained in the metal magnetic powder. Examples of the ionizing component include sulfonic acid, hydrofluoric acid, iron fluoride, nitric acid, hydrochloric acid, phosphoric acid, and carboxylic acid. The solvent may be, for example, water or alcohol, e.g., methanol and ethanol.

In the method for manufacturing the electronic component 1 according to an embodiment of the present disclosure, in the case where the metal magnetic powder is a powder of Fe or Fe alloy and the conductor which is located inside the main body 10 and which has the end portion exposed at the main body is Cu or Ag, the coating film can be made to selectively easily adhere to the metal magnetic powder contained in the main body as compared with the conductor because the ionization tendency of Fe is larger than that of Cu or Ag. That is, the metal magnetic powder is selectively ionized and cations are generated by using the metal magnetic powder containing a metal element which has a higher ionization tendency than the element of the conductor. The resulting cations break the charge balance so that the emulsion state of the resin component is unlikely to be maintained. As a result of this, the resin component is deposited on the main body so as to form the coating layer. At this time, cations of the element conductor are not generated easily in the portion at which the conductor is exposed, so that the coating layer (coating film) can be formed while covering of the exposed conductor is suppressed.

The mixed solution further contains a surfactant in addition to the resin component and the ionizing component. If the surfactant is not deactivated easily, the resin component maintains the emulsion state easily and coating film is not formed easily. However, if the surfactant is deactivated too easily, the mixed solution becomes excessively unstable and hard-to-handle.

Regarding the surfactant, anionic surfactants and nonionic surfactants are used, although the anionic surfactants are particularly preferable. The case where the anionic surfactant has a sulfonic group is preferable because the level of deactivation of the surfactant is appropriate, the coating film 9 is formed easily, and the mixed solution is handled easily. Examples of the anionic surfactant include fatty acid oil, e.g., sodium oleate and caster oil potash, alkylsulfuric acid ester salts, e.g., sodium lauryl sulfate and ammonium lauryl sulfate, alkylbenzenesulfonates, e.g., sodium dodecylbenzenesulfonate, alkylnaphthalenesulfonates, alkanesulfonates, dialkylsulfosuccinates, alkylphosphoric acid ester salts, naphthalenesulfonic acid formalin condensates, polyoxyethylene alkylphenyl ether sulfate ester salts, and polyoxyethylene alkylsulfate ester salts. The above-described surfactants may be used alone or in combination.

The prepared mixed solution is made to adhere to the main body 10, so that a coating layer is formed. The coating layer is a layer which is converted to the coating film 9 by heating. That is, the coating film 9 is formed by heating the coating layer. Specifically, in the case where the resin component is a reactive resin, the solvent is vaporized and the resin component is cured by heating, so that the coating layer is converted to the coating film 9. In the case where the resin component is a nonreactive resin, the coating layer is dried by heating and, thereby, is converted to the coating film 9. In this case, the resin component may be the resin in itself. The method for making the mixed solution adhere to the main body 10 may be dipping, coating, or spraying. In order to enhance the close contact force between the coating layer and the inorganic particles, it is preferable to utilize, for example, coupling formation due to an electrostatic interaction or a chemical reaction. For example, the main body 10 is dipped into a mixed solution containing a commercially available latex, in which the ionizing component and the resin component are dispersed in an aqueous solvent and to which an ionization promoting component and the surfactant are added. A specific example of the composition of the mixed solution is shown in Table 1. In Table 1, the resin component is an acryl-ester copolymer (NipolLATEX SX-1706A (produced by ZEON Corporation)), the anionic surfactant is ELEMINOL JS-2 produced by Sanyo Chemical Industries, Ltd., and the ionizing component is 5% sulfuric acid. Part of the metal magnetic powder contained in the main body 10 (for example, the metal magnetic powder present in the vicinity of the surface of the main body 10) is ionized by dipping.

TABLE 1

| Material name | Amount (ml/l) |
|---|---|
| NipolLATEX SX-1706A | 100 |
| ELEMINOL JS-2 | 35 |
| 5% Sulfuric acid | 50 |
| 30% Aqueous hydrogen peroxide | 2 |
| Pure water | 813 |

Specifically, Fe contained in the metal magnetic powder in the main body 10 becomes cations by ionization. The cations react with the resin component contained in the acryl-ester copolymer (NipolLATEX SX-1706A (produced by ZEON Corporation)) in the mixed solution. In other words, the dispersion stability of the resin component in the mixed solution is degraded because of the presence of the cations and the resin component agglomerates to the cations. As a result, the resin component dispersed in the mixed solution (in the example shown in Table 1, acryl-ester copolymer (NipolLATEX SX-1706A produced by ZEON Corporation)) is neutralized and agglomerates on the surface of the main body 10 constituting the electronic component 1. Consequently, the main body 10 is covered with the coating layer. However, both end portions, which are exposed at the main body 10, of the coil 30 are not covered with the coating layer easily. This is because the constituent element (for example, Cu or Ag) of the coil 30 is a noble element relative to Fe and is not ionized easily, so that the resin component does not agglomerate easily. Therefore, the inorganic particles 15 adhering to the coating layer (coating film 9) do not easily adhere to both end portions, which are exposed at the main body 10 of the coil 30. Consequently, the outer electrodes 20 and 25 can come into direct contact with both end portions of the coil and an increase in direct current resistance of the electronic component can be suppressed while the adhesiveness between the outer electrodes 20 and 25 and the main body 10 is improved by projections and recesses formed by the inorganic particles 15.

After washing with pure water and draining are performed, the inorganic particles 15 are provided to the coating layer (particle provision step). In the present embodiment, the main body 10 is dipped into a colloidal solution of silica particles serving as the inorganic particles 15. In this manner, the inorganic particles 15 adhere to the surface of the coating layer.

After washing with pure water and drying are performed, the coating layer is subjected to a heat treatment. The resin components contained in the coating layer are cross-linked with Fe interposed therebetween or are cross-linked with each other by the heat treatment, so that the coating film 9 is formed.

After the coating layer is formed, the inorganic particles 15 are provided thereto. Specifically, the main body 10 is dried after the coating layer is formed, and the main body is dipped into a dispersion that contains the inorganic particles. The inorganic particles 15 adhere to the coating film 9 by dipping, and the coating layer is cured, so that the inorganic particles 15 can be made to adhere to the surface of the coating film 9. Even in the case where part of the inorganic particles 15 enter the coating film 9, the inorganic particles 15 can be arranged in such a way that the amount of the inorganic particles 15 decreases from the surface of the coating film 9 with increasing proximity to the surface of the main body 10. Therefore, projections and recesses can be formed on the surface of the coating film 9 by the inorganic particles efficiently, so that the adhesiveness between the outer electrodes 20 and 25 and the main body 10 can be improved efficiently. In the dispersion, water or an organic solvent, e.g., alcohols or ketones, or a mixed solvent thereof is used as the dispersion medium. For the purpose of improving the dispersibility, a dispersion stabilizer, e.g., a surfactant, may be added to the dispersion. At least one type of inorganic particles may be contained in the dispersion. The shape of the inorganic particle may be substantially a sphere, an ellipse, a fiber, a pearl, or the like.

For the purpose of improving the coating film strength and the chemical resistance of the coating film 9, an additional treatment may be performed, wherein a curing agent, for example, amine compounds, e.g., ethylamine, propylamine, isopropylamine, butylamine, dimethylamine, diethylamine, dipropylamine, dibutylamine, triethylamine, tripropylamine, allylamine, diallylamine, triallylamine, dimethylethanolamine, diethylethanolamine ethanolamine, diethanolamine, and triethanolamine, amino resins, e.g., melamine resins, guanamine resins, and urea resins, phenol resins, epoxy resins, or isocyanate compounds, is added to the above-described mixed solution and a heat treatment is performed, for example.

Next, the outer electrodes 20 and 25 covering at least part of the surface, to which the inorganic particles 15 adhere, of the coating film 9 are formed (electrode formation step). In the present embodiment, the outer electrode 20 covering the entire surface of the right surface of the main body 10 and part of the upper surface, the bottom surface, the front surface, and the back surface is formed and, in addition, the outer electrode 25 covering the entire surface of the left surface of the main body 10 and part of the upper surface, the bottom surface, the front surface, and the back surface is formed. Specifically, the right surface and the vicinity thereof of the main body 10 are dipped into a conductive material (for example, a Ag paste, a Cu paste, and a colloidal solution containing Pd or Sn) by dipping or the like. The left surface and the vicinity thereof of the main body 10 are dipped into an Ag paste. The Ag paste adhering to the main body 10 is dried and baking is performed, so that underlying electrodes of the outer electrodes 20 and 25 are formed. The surface of the underlying electrodes are subjected to plating (for example, Ni plating and Sn plating, Cu plating, Ni plating, and Sn plating). The electronic component 1 is completed through the above-described steps.

Advantages

According to the electronic component 1 of the present embodiment, firm, close contact of the outer electrodes 20 and 25 with the main body 10 can be facilitated. For more details, the inorganic particles 15 adhere to the surface of the coating film 9. Consequently, projections and recesses are formed on the surface of the coating film 9 by the inorganic particles 15. Then, the outer electrodes 20 and 25 cover the portion, to which the inorganic particles 15 adhere, of the surface of the coating film 9. Consequently, the outer electrodes 20 and 25 enter the projections and recesses formed by the inorganic particles 15. As a result, an anchor effect is generated between the outer electrodes 20 and 25, the coating film 9, and the inorganic particles 15. Therefore, the outer electrodes 20 and 25 come into firm, close contact with the coating film 9.

In the electronic component 1, the coating film 9 covering the main body 10 contains the resin and the metal cations contained in the element of the metal magnetic powder. Such a coating film 9 is thicker than the coating film formed by a chemical conversion treatment with a phosphate, so that excellent abrasion resistance, insulating property, moisture resistance, chemical resistance, and the like are exhibited.

The metal magnetic powder contained in the main body 10 is provided with an insulating cover in advance. However, the insulating cover may peel in the production process of the electronic component 1. In the electronic component 1, the coating film 9 covering the main body 10 contains the resin and metal cations, and the cations are generated by ionizing the metal contained in the metal magnetic powder. Therefore, even in the case where the insulating cover provided to the metal magnetic powder peels, cations are eluted from the metal magnetic powder in the following steps, the cations facilitate formation of the coating film 9, and the metal magnetic powder can be coated. As a result, the electronic component 1 exhibits a more excellent insulating property and rust prevention performance.

Incidentally, in the case where the material for the main body 10 is the mixture of the metal magnetic powder and the resin, in the production process, part of the metal magnetic powder falls from the surface of the main body 10 and recessed portions C are formed on the surface of the main body 10. Formation of recessed portions C increases the area of exposure of the main body 10 to the air. As a result, the main body 10 absorbs moisture in the air easily. In addition, the distance between the coil 30 located in the main body 10 and the surface of the main body 10 decreases by formation of the recessed portions C. For the above-described reasons, the coil 30 is corroded easily by formation of the recessed portions C. In the case where a coating film is formed by the phosphate chemical conversion treatment, as in the electronic component described in Japanese Unexamined Patent Application Publication No. 2013-225718, the resulting film thickness is small and, therefore, it is difficult to fill the recessed portions C. However, in the electronic component 1, the coating film formed by the phosphate chemical conversion treatment is not used but the coating film 9 containing cations of the metal ionized from the main body 10 and the resin is used. The coating film 9 is thicker than the coating film formed by the phosphate chemical conversion treatment and, therefore, can fill the recessed portions C formed by falling of the metal magnetic powder. Consequently, in the electronic component 1, corrosion of the coil 30 can be suppressed. That is, the electronic component 1 exhibits excellent moisture resistance.

In the production step of the electronic component 1, the mixed solution containing the commercially available latex, in which the ionizing component and the resin component are dispersed in an aqueous solvent and to which an ionization promoting component and the surfactant are added, is used. Consequently, the film formation property of the coating film 9 can be enhanced. The production steps of the electronic component 1 are simple as compared with the production steps in which a solution of only the ionizing component and a solution of only the resin component are used separately.

In the production step of the electronic component 1, in the case where sulfuric acid, hydrogen peroxide, hydrofluoric acid, iron fluoride, carboxylic acid, or the like is used as the ionizing component, when the coating film 9 is formed, Fe contained in the main body 10 is ionized, although Cu constituting the coil 30 is hardly ionized. Consequently, the coil 30 is not covered with the coating film 9 easily. That is, in the method for manufacturing the electronic component 1, the coating film 9 can be selectively formed on only the portion in need of coating by utilizing a difference in the solubility mainly on the basis of the ionizing component. That is, the coating film 9 can be formed without covering the portion, which is exposed at the main body 10, of the coil 30.

Figure 4:
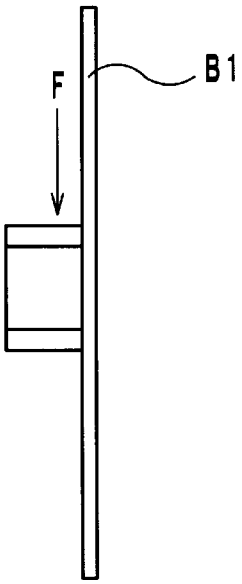
FIG. 4 shows an explanatory diagram of a first experiment.

The present inventors conducted a first experiment and a second experiment in order to examine the effects exerted by the electronic component 1. FIG. 4 is an explanatory diagram of the first experiment.

In order to conduct the first experiment and the second experiment, the present inventors prepared 100 each of the first sample to third sample. The first sample was the electronic component 1, where silica particles were used as the inorganic particles 15. The first sample was obtained by dipping the main body composed of the metal magnetic powder and the resin into a mixed solution having the composition shown in Table 1, performing drying, performing dipping into a dispersion that contains the inorganic particles, and heating the main body. The mixed solution contained the acryl-ester copolymer (NipolLATEX SX-1706A produced by ZEON Corporation) as the resin component and sulfuric acid and hydrogen peroxide as the ionizing components. The second sample was different from the first sample in the point that the inorganic particles 15 did not adhere to the coating film 9. That is, the second sample was obtained by dipping the main body composed of the metal magnetic powder and the resin into a mixed solution having the composition shown in Table 1 and performing drying. The third sample was different from the second sample in the point that the coating film was formed by a chemical conversion treatment with a phosphate treatment solution. That is, the first sample was the example according to an embodiment of the present disclosure and the second and third samples were comparative examples of the present disclosure.

In the first experiment, the present inventors soldered each of the first to third samples to a circuit substrate B1. As shown in FIG. 4, the circuit substrate B1 was stood vertically, and a force F was applied downward to the side surface of each of the first sample to third sample in the vertical direction. At the point in time when each of the first sample to third sample came off the circuit substrate B1, the force F applied to the side surface of each of the first sample to third sample was measured. Table 2 shows the experimental results of the first experiment.

TABLE 2

| | Minimum value | Average value |
|---|---|---|
| First sample | 38N | 40N |
| Second sample | 32N | 34N |
| Third sample | 25N | 28N |

As is clear from Table 2, the first sample firmly adheres to the circuit substrate B1 as compared with the second sample and the third sample. The reason for this is considered to be as described below. In the first sample, the inorganic particles 15 adhere to the coating film 9 whereas in the second sample and the third sample, the inorganic particles do not adhere to the coating film. Consequently, the outer electrodes 20 and 25 in the first sample are in firm, close contact with the coating film 9 as compared with those in the second sample and the third sample. As a result, the outer electrodes 20 and 25 in the first sample do not peel from the main body 10 easily and do not fall from the circuit substrate B1 as compared with those in the second sample and the third sample.

In the second experiment, the present inventors examined whether the first sample to the third sample were normally energized or not under a high-temperature high humidity condition. In the second experiment, a current of 6 A was passed continuously under the condition of a temperature of 85° C.±2° C. and a humidity of 85%±2%. The energization state of each of the first sample to the third sample was examined 24 hours after the start of the experiment. A sample energized 24 hours after the start of the experiment was evaluated as a good product and the sample not energized 24 hours after the start of the experiment was evaluated as a defective product. Table 3 shows the experimental results of the second experiment.

TABLE 3

| | Non-defective rate |
|---|---|
| First sample | 98% |
| Second sample | 97% |
| Third sample | 68% |

As is clear from Table 3, the results of the first sample and the second sample are better than the result of the third sample. The reason for this is considered to be as described below. In the first sample and the second sample, the coating film 9 contained the resin and the metal cations whereas in the third sample, the coating film was formed by the phosphate chemical conversion treatment. Consequently, the film thicknesses of the coating films 9 in the first sample and the second sample were larger than the film thickness of the coating film in the third sample and the moisture resistance of each of the first sample and the second sample was higher than the moisture resistance of the third sample.

First Modified Example

An electronic component 1*a* according to a first modified example will be described below. The structure of the electronic component 1*a* is the same as the structure of the electronic component 1 and, therefore, explanations thereof will not be provided. The electronic component 1*a* is different from the electronic component 1 in the point that zirconium particles are used as the inorganic particles 15. The first modified example is an example of the present disclosure.

The present inventors conducted the first experiment with respect to the electronic component 1*a* according to the first modified example. Specifically, 100 fourth samples, which were electronic components 1*a*, were prepared and the first experiment was conducted. When the fourth sample came off the circuit substrate B1, the minimum value of the force applied to the side surface of the fourth sample was 37 N and the average value was 39 N. Therefore, firm, close contact of the outer electrodes 20 and 25 with the main body 10 was able to be facilitated in the electronic component 1*a*, in which zirconium oxide particles were used as the inorganic particles 15, as well in the same manner as the electronic component 1. As described above, various materials can be used for the inorganic particles 15.

Second Modified Example

Figure 5:
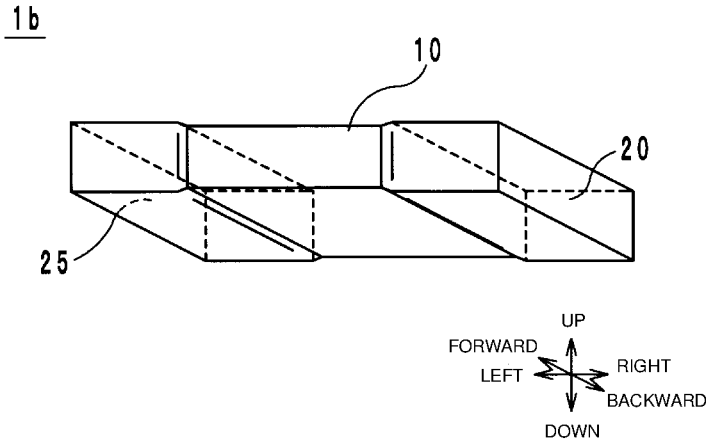
FIG. 5 shows an outside perspective view of an electronic component according to a second modified example.
Figure 6:
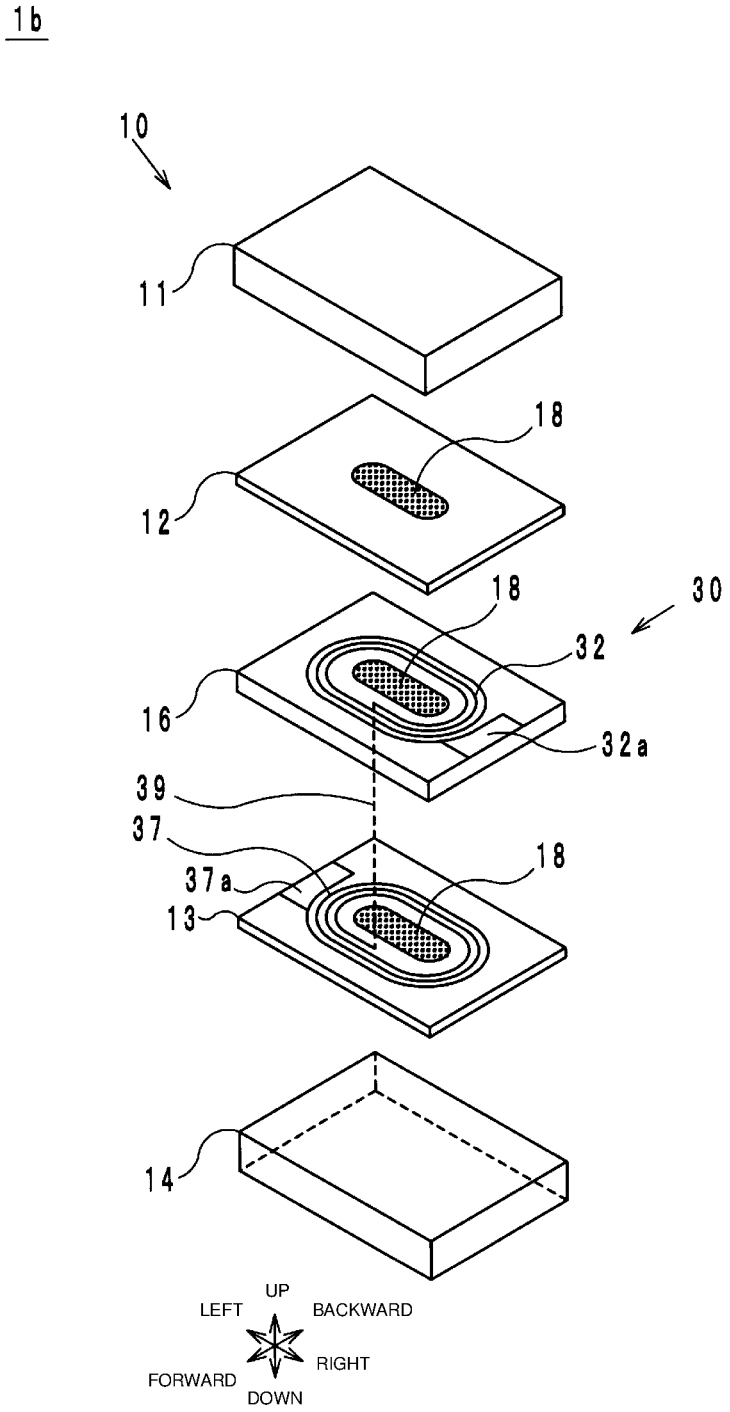
FIG. 6 shows an exploded perspective view of the electronic component.
Figure 7:
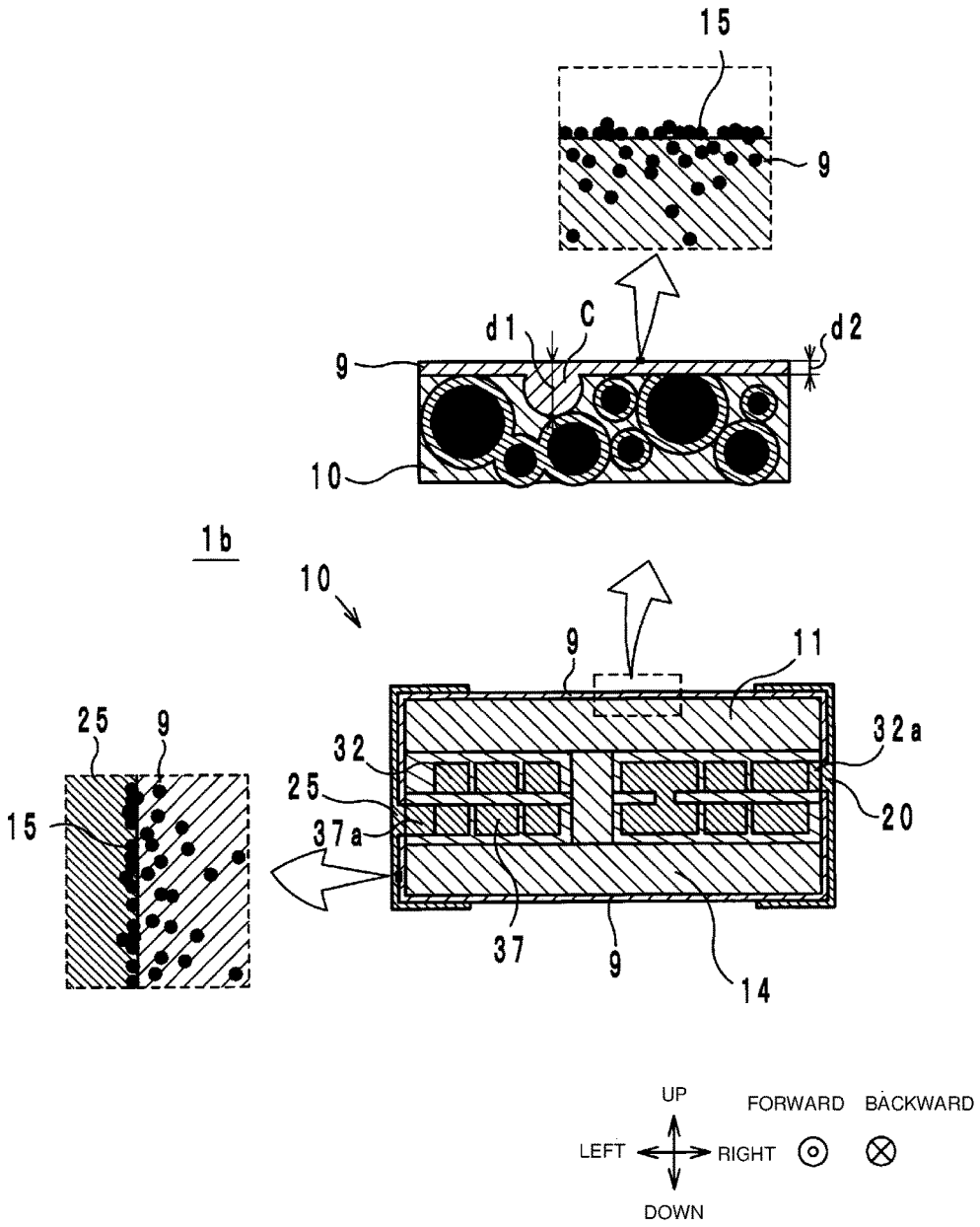
FIG. 7 shows a structural sectional view and magnified diagrams of the electronic component.

The configuration of an electronic component according to a second modified example will be described below with reference to the drawings. FIG. 5 shows an outside perspective view of an electronic component 1*b* according to the second modified example. FIG. 6 shows an exploded perspective view of the electronic component 1*b*. FIG. 7 shows a structural sectional view and magnified diagrams of the electronic component 1*b*. Hereafter, the stacking direction of the electronic component 1*b* is defined as a vertical direction, and the direction of alignment of the outer electrodes 20 and 25 is defined as a lateral direction. The direction orthogonal to the vertical direction and the lateral direction is defined as the forward or backward direction. The forward or backward direction, the lateral direction, and the vertical direction are orthogonal to each other.

The electronic component 1*b* is different from the electronic component 1 in the point that the main body 10 is a multilayer body. The electronic component 1*b* will be described centering on such a difference point below.

As shown in FIG. 5 to FIG. 7, the electronic component 1*b* includes the coating film 9, the main body 10, the inorganic particles 15, the outer electrodes 20 and 25, and the coil 30.

As shown in FIG. 6, the main body 10 has a substantially rectangular parallelepiped shape and includes insulator layers 11 to 14, an insulator substrate 16, and a magnetic path 18. The insulator layers 11 and 12, the insulator substrate 16, and the insulator layers 13 and 14 are stacked in that order from the top toward the bottom.

The insulator layers 11 and 14 are substantially rectangular and the material is a mixture of the metal magnetic powder and the insulating resin. In the present embodiment, the insulator layers 11 and 14 are produced from a mixture of the metal magnetic powder and the epoxy resin. The metal magnetic powder of the electronic component 1*b* is the same as the metal magnetic powder of the electronic component 1 and, therefore, explanations thereof will not be provided. For example, the thicknesses of the insulator layers 11 and 14 are about 60 μm and are smaller than the maximum particle diameter of the metal magnetic powder contained in the insulator layers 11 and 14.

The insulator layers 12 and 13 are produced from an epoxy resin or the like. The insulator layers 12 and 13 may be substantially rectangular in plan view. The material for the insulator layers 12 and 13 may be the insulating resin, e.g., benzodichlorobutene, or an insulating inorganic material, e.g., glass ceramic.

The insulator substrate 16 is substantially rectangular and is a printed wiring board in which a glass cloth is impregnated with an epoxy resin. The material for the insulator substrate 16 may be the insulating resin, e.g., benzocyclobutene, or an insulating inorganic material, e.g., glass ceramic.

The magnetic path 18 has a substantially columnar shape extending in the vertical direction in an almost central portion inside the main body 10 and contains the metal magnetic powder and the resin. The material for the magnetic path 18 is the same as the material for the insulator layers 11 and 14 and, therefore, explanations thereof will not be provided. The magnetic path 18 penetrates the insulator layers 12 and 13 and the insulator substrate 16 in the vertical direction. The shape of the cross-section perpendicular to the vertical direction of the magnetic path 18 is a substantially oval shape.

The coil 30 is an example of the conductor disposed in the main body 10 and is produced from an electrically conductive material, e.g., Au, Ag, Cu, Pd, or Ni. The coil 30 includes coil portions 32 and 37, lead portions 32*a* and 37*a*, and a via hole conductor 39.

As shown in FIG. 6, the coil portion 32 is disposed on the upper surface of the insulator substrate 16 and is a spiral conductor layer which is wound clockwise from the outer circumference side toward the inner circumference side in plan view. As shown in FIG. 6, the coil portion 37 is disposed on the lower surface of the insulator substrate 16 and is a spiral conductor layer which is wound clockwise from the inner circumference side toward the outer circumference side in plan view. For the sake of understanding, in FIG. 6, the coil portion 37 is shown on the upper surface of the insulator layer 13.

The lead portion 32*a* is connected to the end portion on the outer circumference side of the coil portion 32 and is led to the right short side of the upper surface of the insulator substrate 16. Consequently, the lead portion 32*a* is exposed to the outside at the right surface of the main body 10. The lead portion 37*a* is connected to the end portion on the outer circumference side of the coil portion 37 and is led to the left short side of the lower surface of the insulator substrate 16. Consequently, the lead portion 37*a* is exposed to the outside at the left surface of the main body 10. For the sake of understanding, in FIG. 6, the lead portion 37*a* is shown on the upper surface of the insulator layer 13.

The via hole conductor 39 penetrates the insulator substrate 16 in the vertical direction and connects the end portion on the inner circumference side of the coil portion 32 to the end portion on the inner circumference side of the coil portion 37.

As shown in FIG. 7, the coating film 9 covers at least part of the surface of the main body 10. In the present embodiment, the coating film 9 covers almost the entire surface of the main body 10. However, in order that the connection between the coil 30 and the outer electrodes 20 and 25 is not impaired, the coating film 9 does not cover the portions, at which the lead portions 32*a* and 37*a* are exposed to the outside, of the main body 10. The details of the coating film 9 in the electronic component 1*b* is the same as the details of the coating film 9 in the electronic component 1 and, therefore, explanations thereof will not be provided.

As shown in FIG. 7, the inorganic particles 15 are silica particles adhering to at least part of the surface of the coating film 9. In the present embodiment, the inorganic particles 15 adhere to almost the entire surface of the coating film 9. However, in order that the connection between the coil and the outer electrodes 20 and 25 is not impaired, the inorganic particles 15 do not adhere to the portions, at which the lead portions 32*a* and 37*a* are exposed to the outside, of the main body 10. The details of the inorganic particles 15 in the electronic component 1*b* is the same as the details of the inorganic particles 15 in the electronic component 1 and, therefore, explanations thereof will not be provided.

The outer electrode 20 is electrically connected to the coil 30 and covers at least part of the portion, to which the inorganic particles 15 adhere, of the surface of the coating film 9. In the present embodiment, the outer electrode 20 covers the entire right surface of the main body 10 and, in addition, covers part of the upper surface, the bottom surface, the front surface, and the back surface of the main body 10. Consequently, the outer electrode 20 is connected to the lead portion 32*a*.

The outer electrode 25 is electrically connected to the coil 30 and covers at least part of the portion, to which the inorganic particles 15 adhere, of the surface of the coating film 9. In the present embodiment, the outer electrode 25 covers the entire left surface of the main body 10 and, in addition, covers part of the upper surface, the bottom surface, the front surface, and the back surface of the main body 10. Consequently, the outer electrode 25 is connected to the lead portion 37*a*.

The method for manufacturing the main body 10 of the electronic component 1*b* is a common method and, therefore, explanations thereof will not be provided. Formation of the coating film 9 and provision of the inorganic particles 15 in the electronic component 1*b* are the same as formation of the coating film 9 and provision of the inorganic particles 15 in the electronic component 1 and, therefore, explanations thereof will not be provided.

The thus configured electronic component 1*b* can have the same operations and advantages as those of the electronic component 1.

Other Embodiments

The electronic component according to the present disclosure is not limited to the electronic components 1, 1*a*, and 1*b* and modifications can be made within the scope of the gist of the disclosure.

The configurations of the electronic components 1, 1*a*, and 1*b* may be combined optionally.

The coating film 9 covers almost the entire surface of the main body 10 but may cover part of the surface of the main body 10. The inorganic particles 15 adhere to almost the entire surface of the coating film 9 but may adhere to part of the surface of the coating film 9. For example, the inorganic particles 15 may adhere to only the portion to be provided with the outer electrodes 20 and 25 of the surface of the coating film 9.

In the electronic components 1, 1*a*, and 1*b*, the coating film 9 covers almost the entire surface of the main body 10 and the inorganic particles 15 are provided to almost the entire surface of the coating film 9. Consequently, the inorganic particles 15 are present at almost the entire interfaces between the coating film 9 and the outer electrodes 20 and 25. However, the inorganic particles 15 are not necessarily present at almost the entire interfaces between the coating film 9 and the outer electrodes 20 and 25 and may be present at only part of the interfaces between the coating film 9 and the outer electrodes 20 and 25.

In the method for manufacturing the electronic component 1, in order to provide the inorganic particles 15 to the coating film 9, the main body 10 is dipped into the colloidal solution of the silica particles serving as the inorganic particles 15. However, the method for providing the inorganic particles 15 to the coating film 9 is not limited to this. For example, the main body 10 may be dipped into an aqueous solution of the inorganic particles 15, or an aqueous solution or a colloidal solution of the inorganic particles 15 may be sprayed or applied to the main body 10. Alternatively, a powder of the inorganic particles 15 may be made to adhere to the main body 10.

In the electronic components 1, 1*a*, and 1*b*, the coil 30 is mentioned as an example of the conductor. However, the conductor is not necessarily a wound conductor wire, e.g., the coil 30. The entirety of the conductor is not necessarily present inside the main body 10. The only requirement is that part of the conductor is disposed inside the main body 10. Therefore, part of the conductor may be exposed at the main body 10, or part of the conductor may be located on the surface of the main body 10.

The metal cations contained in the coating film 9 are not necessarily cations of the metal contained in the metal magnetic powder but may be cations of the metal contained in the resin of the coating film 9 or be other metal cations.

The metal magnetic powder may be, for example, an Fe powder, an iron carbonyl powder, or a powder of an alloy containing iron and Si (for example, Fe—Si—Cr alloys, Fe—Si alloys, and Fe—Si—Al alloys). The resin contained in the coating film 9 may be epoxy resins, polyimide resins, silicone resins, polyamide imide resins, polyether ether ketone resins, fluororesins, acryl silicone resins, and the like. Besides them, examples of resins contained in the coating film 9 include polymer resins produced from at least one monomer selected from methyl acrylate, ethyl acrylate, n-butyl acrylate, 2-hydroxyethyl acrylate, 2-hydroxypropyl acrylate, 2-ethylhexyl acrylate, methyl methacrylate, ethyl methacrylate, n-butyl methacrylate, 2-hydroxyethyl methacrylate, 2-hydroxypropyl methacrylate, glycidyl acrylate, glycidyl methacrylate, acrylamide, methacrylamide, acrylonitrile, styrene, ethylene, butadiene, vinyl chloride, vinylidene chloride, vinyl acetate, acrylic acid, methacrylic acid, and the like. In this regard, even when a polymerization initiator, e.g., ammonium persulfate, potassium persulfate, and t-butylhydroperoxide, for obtaining the above-described resin is contained in the above-described resin, the characteristics of the coating film 9 are not affected.

An anionic surfactant or a nonionic surfactant may be used instead of the surfactant ELEMINOL JS-2 (produced by Sanyo Chemical Industries, Ltd.) as a material for adjusting the thickness of the coating film 9. Specifically, examples of anionic surfactants include alkylbenzene sulfonates, alkyl disulfates, alkyldiphenyl ether disulfonates, polyoxyethylene alkyl phenyl ether sulfates, polyoxyethylene aryl ether sulfates, carboxylate surfactants, phosphate surfactants, naphthalenesulfonic acid formalin condensates, and polycarboxylic acid surfactants. Examples of nonionic surfactants include polyoxyethylene alkyl ethers (alkyl group: octyl, decyl, lauryl, stearyl, oleyl, and the like), polyoxyethylene alkylphenyl ethers (alkyl group: octyl, nonyl, and the like), and polyoxyethylene-polyoxypropylene block copolymers. Also, water-soluble resins having a sulfonic group and salts thereof, a carboxyl group and salts thereof, and a phosphoric group and salts thereof are mentioned.

In addition to the above-described materials, tannin for improving the corrosion resistance, a plasticizer, e.g., dibutyl phthalate, for providing the flexibility to the coating film 9, metal ions of silver fluoride or the like for improving the film formation property of the coating film 9, and lubricant, e.g., fluororesin lubricant, polyolefin wax, melamine cyanurate, and molybdenum disulfide, for preventing scratching and improving the water resistance of the surface of the coating film 9 may be added to the mixed solution for forming the coating film 9.

In addition, for the purpose of improving the corrosion resistance of the coating film 9 and coloring the electronic component, pigments, e.g., carbon black and phthalocyanine blue, may be added to the mixed solution for forming the coating film 9.

The corrosion resistance and the chemical resistance can be improved by adding a high molecular polymer having an acid group containing phosphorus, for example, an organic high molecular compound having a phosphoric group, a phosphorous group, a phosphonic group, a phosphinic group, or the like in the main chain or the side chain, to the mixed solution for forming the coating film 9.

From the viewpoint of improving the strength, the thermal conductivity, and the electrical conductivity of the coating film 9, a filler and the like, e.g., glass fibers, calcium carbonate, aramid fibers, graphite, alumina, aluminum nitride, and boron nitride, may be added to the mixed solution.

As described above, the present disclosure is very useful for the electronic component and the method for manufacturing the electronic component and, in particular, is excellent in the point that firm, close contact of the outer electrodes with the main body can be facilitated.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a main body made from a metal magnetic powder and an insulating resin;

a coating film covering the surface of the main body;

a conductor disposed inside the main body;

inorganic particles adhering to the surface of the coating film, the inorganic particles having an average particle diameter of 1 nm or more and 200 nm or less; and outer electrodes which are electrically connected to the conductor and which cover portions of the surface of the coating film while inorganic particles adhere to the portions, wherein the coating film contains a resin and metal cations.

2. The electronic component according to claim 1, further comprising the inorganic particles in the coating film, wherein an amount of the inorganic particles contained in a unit volume of the coating film decreases from a surface of the coating film with increasing proximity to a surface of the main body.

3. The electronic component according to claim 1, wherein the inorganic particles are disposed to facilitate close contact of the outer electrode with the coating film.

4. The electronic component according to claim 1, wherein the metal cations are cations of a metal contained in the metal magnetic powder.

5. The electronic component according to claim 1, wherein the metal magnetic powder is a powder of Fe or an Fe alloy, and the conductor is Cu or Ag.

6. The electronic component according to claim 4, wherein the metal magnetic powder is a powder of Fe or an Fe alloy, and the conductor is Cu or Ag.

7. An electronic component comprising:

a main body made from a metal magnetic powder and an insulating resin;

a coating film covering the surface of the main body;

a conductor disposed inside the main body;

inorganic particles adhering to the surface of the coating film, the inorganic particles cover 20% or more of the surface of the coating film; and outer electrodes which are electrically connected to the conductor and which cover portions of the surface of the coating film while inorganic particles adhere to the portions, wherein the coating film contains a reactant of a resin and metal cations, and the metal cations are derived from the metal magnetic powder in the main body.

8. The electronic component according to claim 7, wherein the metal magnetic powder contains an element having a greater ionization tendency than an element constituting the conductor.

* * * * *